United States Patent [19]

Nonnenmann et al.

[11] Patent Number: 4,655,686

[45] Date of Patent: Apr. 7, 1987

[54] AIR CONVEYING DEVICE ON A RADIATOR FOR WATER-COOLED INTERNAL COMBUSTION ENGINES

[75] Inventors: Manfred Nonnenmann, Schwieberdingen; Kurt Hauser; Hans-Dieter Gohl, both of Stuttgart, all of Fed. Rep. of Germany

[73] Assignee: Daimler-Benz Aktiengesellschaft, Fed. Rep. of Germany

[21] Appl. No.: 767,050

[22] Filed: Aug. 19, 1985

[30] Foreign Application Priority Data

Aug. 30, 1984 [DE] Fed. Rep. of Germany ..... 3431801

[51] Int. Cl.[4] ..... F04D 29/32; F04D 29/64

[52] U.S. Cl. ..... 416/189; 416/169 A; 416/191; 416/60; 123/41.49

[58] Field of Search ..... 416/190, 195, 191, 196 R, 416/169 A, 60, 189 R; 123/41.49

[56] References Cited

U.S. PATENT DOCUMENTS

| | | | |
|---|---|---|---|
| 1,203,984 | 11/1916 | Corey | 416/60 |
| 1,209,863 | 12/1916 | Loomis | 123/41.49 X |
| 1,278,396 | 9/1918 | Speiser | 123/41.49 X |
| 1,291,199 | 1/1919 | Short | 123/41.49 X |
| 1,292,830 | 1/1919 | McCain | 416/191 |
| 1,873,379 | 8/1932 | Frentzel | 123/41.49 |
| 2,853,140 | 9/1958 | Forth | 416/195 X |

FOREIGN PATENT DOCUMENTS

| | | | |
|---|---|---|---|
| 0073476 | 3/1983 | European Pat. Off. . | |
| 569801 | 4/1924 | France | 416/189 R |
| 730955 | 8/1932 | France | 416/195 |
| 9478 | of 1901 | United Kingdom | 416/195 |
| 833938 | 5/1960 | United Kingdom | 416/189 R |
| 1427278 | 3/1976 | United Kingdom . | |
| 2072760 | 10/1981 | United Kingdom | 416/191 |

*Primary Examiner*—Everette A. Powell, Jr.

*Attorney, Agent, or Firm*—Barnes & Thornburg

[57] ABSTRACT

An air conveying device is provided on a radiator for water cooled internal combustion engines. The device comprises a fan rotor supported on the internal combustion engine by means of a fan rotor shaft on which is located a belt pulley for a driving belt. A fan shroud surrounds the outer ends of the fan blades and is fastened to the blade tips. So that even belts with a relatively short belt length can be installed from the fan rotor direction, the fan shroud has at least one slot extending in the axial direction for inserting the belt and for slipping the length of belt which is positioned at the shaft-free end of the fan rotor over the fan shroud.

12 Claims, 6 Drawing Figures

AIR CONVEYING DEVICE ON A RADIATOR FOR WATER-COOLED INTERNAL COMBUSTION ENGINES

BACKGROUND AND SUMMARY OF THE INVENTION

The present invention relates to an air conveying device for a water-cooled internal combustion engine, having a fan rotor supported on the internal combustion engine by means of a fan rotor shaft. A belt pulley for a driving belt is located on the shaft and the fan rotor is provided with a peripneral fan shroud surrounding the outer ends of the fan blades.

Such an air conveying device with a fan shroud surrounding the fan blades on the fan rotor and connected to the blade tips is known from the German Offenlegungsschrift No. 2,826,697. The fan rotor is supported on the internal combustion engine by means of a fan rotor shaft, on which is located a V-belt pulley for accepting one or more V-belts for driving the fan rotor and other accessories of the internal combustion engine.

Changing a defective V-belt on a fan rotor with a peripheral fan shroud is frequently associated with substantial problems, depending on the length of the V-belt. Thus, for example it is only possible to change V-belts without difficulty if their diameter is greater than that of the fan shroud. In this case, they can simply be pushed over the fan rotor for insertion or removal purposes. On the other hand, a V-belt naving a diameter which is smaller than that of the fan shroud can only be changed after the complete fan rotor has been removed. Such a fan rotor removal process is associated with a substantial expenditure of time and fitting effort.

An objective of the present invention is to improve the aforementioned air conveying device in such a way that even belts with a smaller diameter than that of the fan shroud can be changed without removing the fan rotor.

This and other objectives of the present invention are attained in the provision of an air conveying device having a fan shroud which has at least one slot extending in the axial direction for inserting the belt and for slipping the length of belt which is positioned at the shaft-free end of the fan rotor over the fan shroud. As a result of the invention, defective belts can be changed without removing the fan rotor even in the case of fans with a peripheral fan shroud connected to the blades.

Other objects, advantages and novel features of the present invention will become apparent from the following detailed description of the invention when considered in conjunction with the accompanying drawings.

DETAILED DESCRIPTION OF THE DRAWINGS

Figure 1:
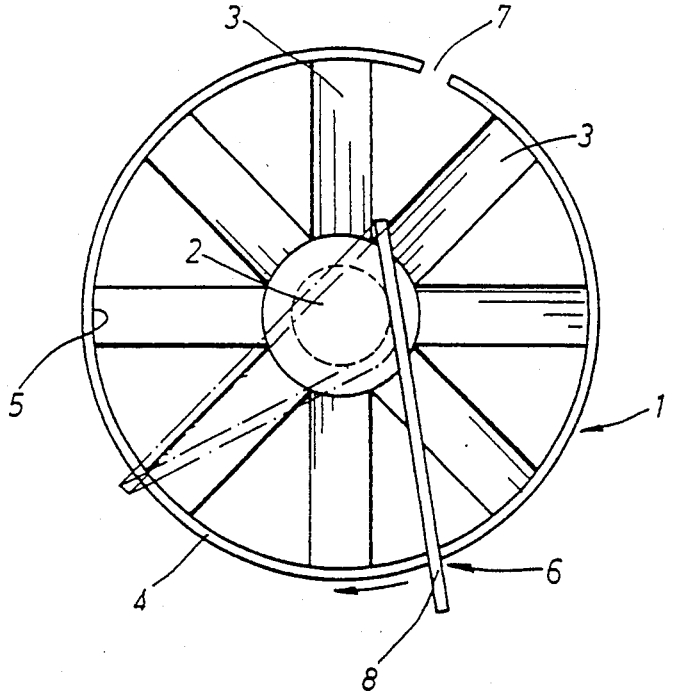
FIG. 1 is a front schematic view of a fan rotor with a peripheral fan shroud constructed in accordance with a preferred embodiment of the present invention.
Figure 5:
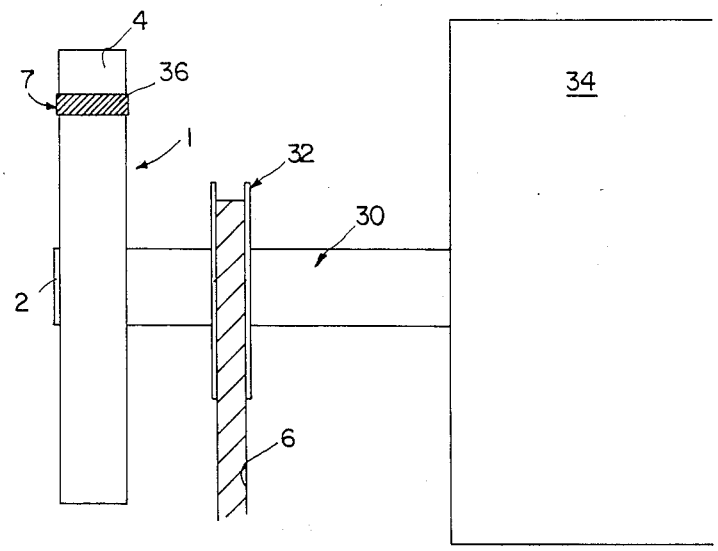
FIG. 5 is a schematic side view of a fan rotor assembly installed in a vehicle in accordance with the illustrated preferred embodiments of present invention.
Figure 6:
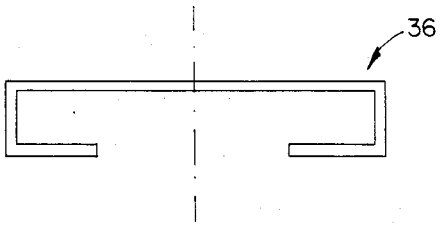
FIG. 6 is a schematic front view of a removable cap which covers the slot in the fan shroud.

In FIG. 1, the fan rotor 1 of an air conveying device for the radiator of a water-cooled internal combustion engine is shown. The fan rotor 1 has a fan hub 2, to which are attached radially protruding fan blades 3. The fan blades 3 are surrounded by a fan shroud 4, which is connected to the fan blades 3 at the fan tips 5. As schematically depicted in FIG. 5, the fan rotor 1 is rotatably supported at the end of the internal combustion engine 34 by means of an outlet side fan rotor shaft 30. A V-belt pulley 32 for a V-belt 6, which provides the drive of the fan rotor 1 from the crankshaft, is fitted to the fan rotor shaft. The auxiliaries located on the internal combustion engine can be simultaneously driven from the fan rotor shaft by means of further V-belts.

Because of the desired compact construction of internal combustion engines, the V-belts are of relatively short installation length and have, in consequence, a diameter which is generally smaller than the diameter of the fan shroud 4.

So that such V-belts can be fitted without removing the fan rotor 1, the fan shroud 4 is provided with a slot 7 extending in the axial direction. As shown in FIG. 1, the slot 7 is located in a peripheral region, extending between two fan blades 3, of the fan shroud 4. In order to fit it from outside, the V-belt 6 is inserted through the slot 7 between the two fan blades 3 and pushed as far as the fan hub 2. If, during this operation, the slot 7 is located at the top of the fan rotor, the V-belt 6 falls to the bottom of the fan rotor in the position shown by full lines. The length of belt 8 located in front of the shaft-free end of the fan rotor 3 is then pulled over the periphery of the of the fan shroud 4—as indicated by the chain-dotted lines. The V-belt 6 now hangs on the fan rotor shaft 30 and only needs to be pulled onto the corresponding V-belt pulley 32.

Figure 2:
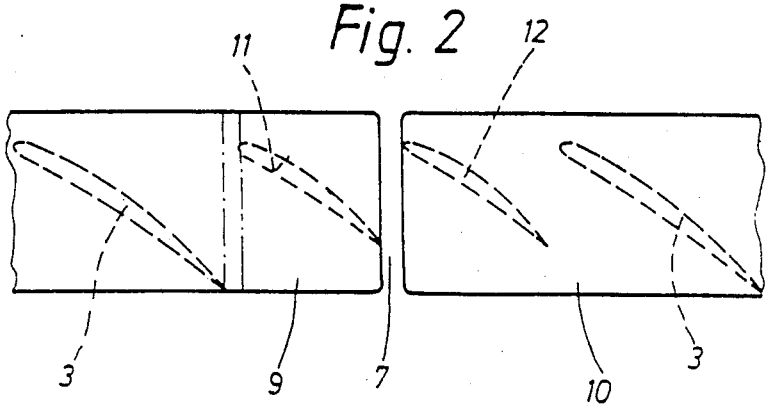
FIG. 2 is a partial plan schematic view showing the arrangement of the slot in the fan shroud of the FIG. 1 emoodiment.

Because the fan shroud 4 is now discontinuous, its strength is substantially reduced. In order to make it possible to compensate for the loss of strength, the parts of the shroud located on each side of the slot 7 are connected to the hub, as shown in FIG. 2, by means of auxiliary blades 11 and 12 designed as struts. The auxiliary blades 11 and 12 located immediately adjacent to the slot 7 for this purpose may also have a different shape. It is, however, advantageous to employ a strut shape which does not adversely affect the efficiency of the fan rotor 1.

Independent of these considerations, the slot 7 can, as indicated in FIG. 2 by chain-dotted lines, be located in the immediate vicinity of a fan blade 3. Accordingly, the shroud piece 9 is directly above the fan blade 3 and only the shroud piece 10 has to be supported by the special auxiliary blade 11. This avoids the need for the auxiliary blade 12.

Figure 3:
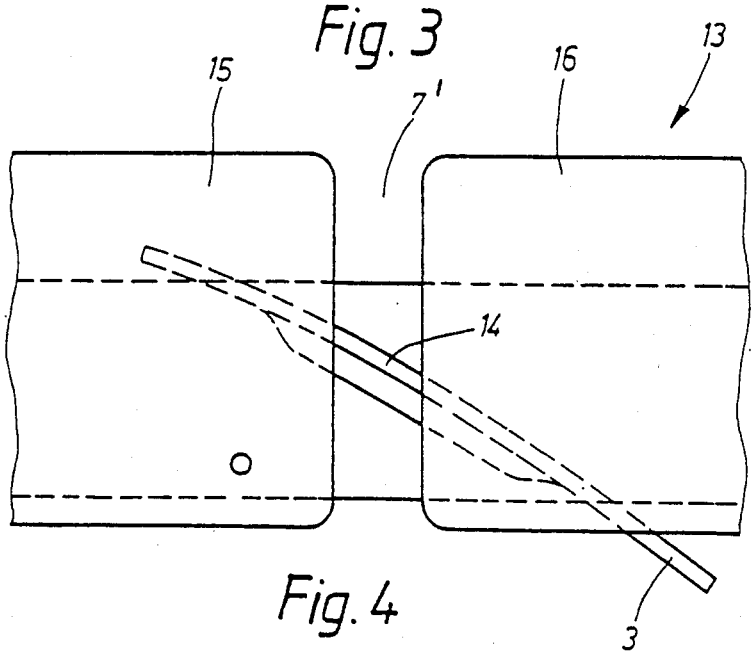
FIG. 3 is a partial enlarged plan view of an alternative preferred embodiment of the invention with a fan shroud with the better accommodating slot located in a radial plane of a fan blade.

In accordance with the embodiment of FIG. 3, which is generally similar to the arrangement of FIGS. 1 and 5, but with a modified belt assembly accommodating slot arrangement, the slot is located in a shroud section 13 extending in a radial prolongation of a fan blade 3. The fan blade 3 is provided with a recess 14 by means of which the slot 7' extends as far as the region of the fan hub 2. This obviates the need for both the struts providing the strength connection for the shroud pieces 15 and 16 located on both sides adjacent to the slot.

Figure 4:
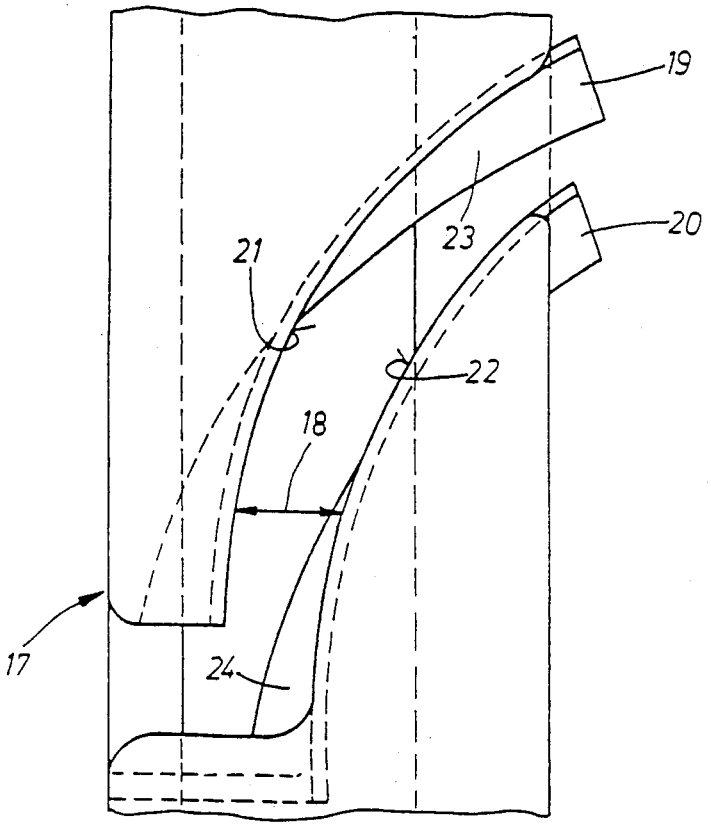
FIG. 4 is a partial plan schematic view of another preferred embodiment of the invention with a fan shroud with a slot matched to the contour and shape of the fan blades.

In the embodiment example of FIG. 4, which is generally similar to the arrangement of FIGS. 1 and 5, but with a modified belt assembly accommodating slot arrangement, a slot 18 is located between a fan blade 19 and an auxiliary fan blade 20 in a shroud section 17. The slot 18 is designed in a curve corresponding to the shape in the axial direction and to the contour of the blades. The lengthwise edges 21 and 22 formed by the slot within the shroud section 17 each lie in the radial plane of the facing blade surfaces 23 and 24 of the blades 19 and 20. The lengthwise edge 21 then follows the shape of the blade surface 23 on the fan blade 19 and the lengthwise edge 22 follows the shape of the blade surface 24 on the auxiliary blade 20. The result of this is that the blades 19 and 20 act as supports for the lengthwise edges 21 and 22 over the total axial extent of the slot 18.

Within the scope of the invention, it is contemplated that the slot 7, 7' or 18 be covered by an easily removable cap 36 (see FIG. 5) attached to the fan shroud 4. In addition, the present invention is quite generally applicable to both axial and semi-axial fans with peripheral fan shrouds, designed from sheet metal or plastic. Finally, the invention is also applicable to such fan rotors as are directly driven from the crankshaft of the internal combustion engine. The belt pulleys located on the fan rotor shaft are then used exclusively for driving accessories or auxiliaries.

Although the invention has been described and illustrated in detail, it is to be clearly understood that the above is to be taken by way of illustration and example only and not by way of limitation. The spirit and scope of the invention are to be limited only by the terms of the appended claims.

What is claimed is:

1. An air conveying arrangement for supplying cooling air to a vehicle motor radiator comprising:

rotatably mounted belt drive fan rotor means having peripheral fan shroud means;

said peripheral fan shroud means having at least one drive belt assembly accommodating slot, said slot having a construction allowing said belt to be inserted therethrough and slipped over said fan shroud means for positioning in an operative position without removal of said fan rotor means, wherein said fan rotor means includes a fan hub means and fan blade means extending between said fan hub means and said fan shroud means;

rotatably mounted fan rotor shaft means fixedly attached to said fan rotor means; and belt pulley means on said fan rotor shaft means for engaging driving belt means.

2. An air conveying arrangement for supplying cooling air to a vehicle motor radiator comprising:

rotatably mounted belt drive fan rotor means having peripheral fan shroud means, said peripheral fan shroud means having at least one drive belt assembly accommodating slot, said slot having a construction allowing said belt to be inserted therethrough and slipped over said fan shroud means for positioning in an operative position without removal of said fan rotor means, wherein said fan rotor means includes a fan hub means and fan blade means extending between said fan hub means and said fan shroud means, wherein said slot is disposed in said fan shroud means between two adjacently arranged fan blades.

3. An air conveying arrangement for supplying cooling air to a vehicle motor radiator comprising:

rotatably mounted belt drive fan rotor means having peripheral fan shroud means, said peripheral fan shroud means having at least one drive belt assembly accommodating slot, said slot having a construction allowing said belt to be inserted therethrough and slipped over said fan shroud means for positioning in an operative position without removal of said fan rotor means, wherein said fan rotor means includes a fan hub means and fan blade means extending between said fan hub means and said fan shroud means, wherein said slot extends radially inward through said fan shroud into a recess in one of said fan blades.

4. An air conveying arrangement according to claim 2, further comprising strut means on either side of said slot for supporting said shroud means.

5. An air conveying arrangement according to claim 4, wherein said strut means comprise auxiliary blade means.

6. An air conveying arrangement according to claim 4, wherein one strut means comprises a fan blade and another strut comprises auxiliary blade means.

7. An air conveying arrangement according to claim 3, wherein said slot extends radially inward to said fan hub means.

8. An air conveying arrangement according to claim 2, wherein said slot extends radially inward through said shroud means into a recess, said recess having a pair of walls formed by opposing surfaces of said adjacently arranged blades.

9. An air conveying arrangement according to claim 8, wherein said recess extends inwardly to said fan hub.

10. An air conveying arrangement according to claim 8, wherein at least one of said adjacently arranged blades is an auxiliary blade.

11. An air conveying arrangement according to claim 1, further comprising cap means engageable with said fan shroud means for covering said slot.

12. An air conveying arrangement according to claim 1, wherein said slot extends substantially parallel to the rotational axis of the rotor means.

* * * * *

UNITED STATES PATENT AND TRADEMARK OFFICE

CERTIFICATE OF CORRECTION

PATENT NO. : 4,655,686

DATED : April 7, 1987

INVENTOR(S) : Manfred NONNENMANN, et al.

It is certified that error appears in the above-identified patent and that said Letters Patent is hereby corrected as shown below:

On the Title Page:

In field [73] please add the following assignee:

Süddeutsche Kühlerfabrik

Julius Fr. Behr GmbH & Co. KG.

Federal Republic of Germany

Signed and Sealed this

Fifteenth Day of December, 1987

*Attest:*

DONALD J. QUIGG

*Attesting Officer*

*Commissioner of Patents and Trademarks*